United States Patent [19]

Yan

[11] 4,234,231

[45] Nov. 18, 1980

[54] METHOD FOR RESTORING A LEACHED FORMATION

[75] Inventor: Tsoung-Yuan Yan, Philadelphia, Pa.

[73] Assignee: Mobil Oil Corporation, New York, N.Y.

[21] Appl. No.: 966,933

[22] Filed: Dec. 6, 1978

[51] Int. Cl.[2] ..... E21B 43/28

[52] U.S. Cl. ..... 299/4

[58] Field of Search ..... 423/17; 299/4, 5

[56] References Cited

U.S. PATENT DOCUMENTS

| | | | |
|---|---|---|---|
| 4,108,922 | 8/1978 | Stover | 299/4 |
| 4,155,982 | 5/1979 | Hunlin et al. | 299/5 |

*Primary Examiner*—William F. Pate, III

*Attorney, Agent, or Firm*—C. A. Huggett; Drude Faulconer

[57] ABSTRACT

A method for restoring a formation which has undergone an in situ leaching operation wherein minerals oxidized during the leach operation pose a contamination threat to the formation water. In the present invention, the formation is flushed with a restoration fluid which contains a reducing agent capable of reducing the oxidized minerals to their reduced, insoluble state so that they are redeposited into the formation. Examples of suitable reducing agents are hydrogen gas, hydrogen sulfide, sulfur dioxide, carbon monoxide, and ferrous iron solutions.

12 Claims, 1 Drawing Figure

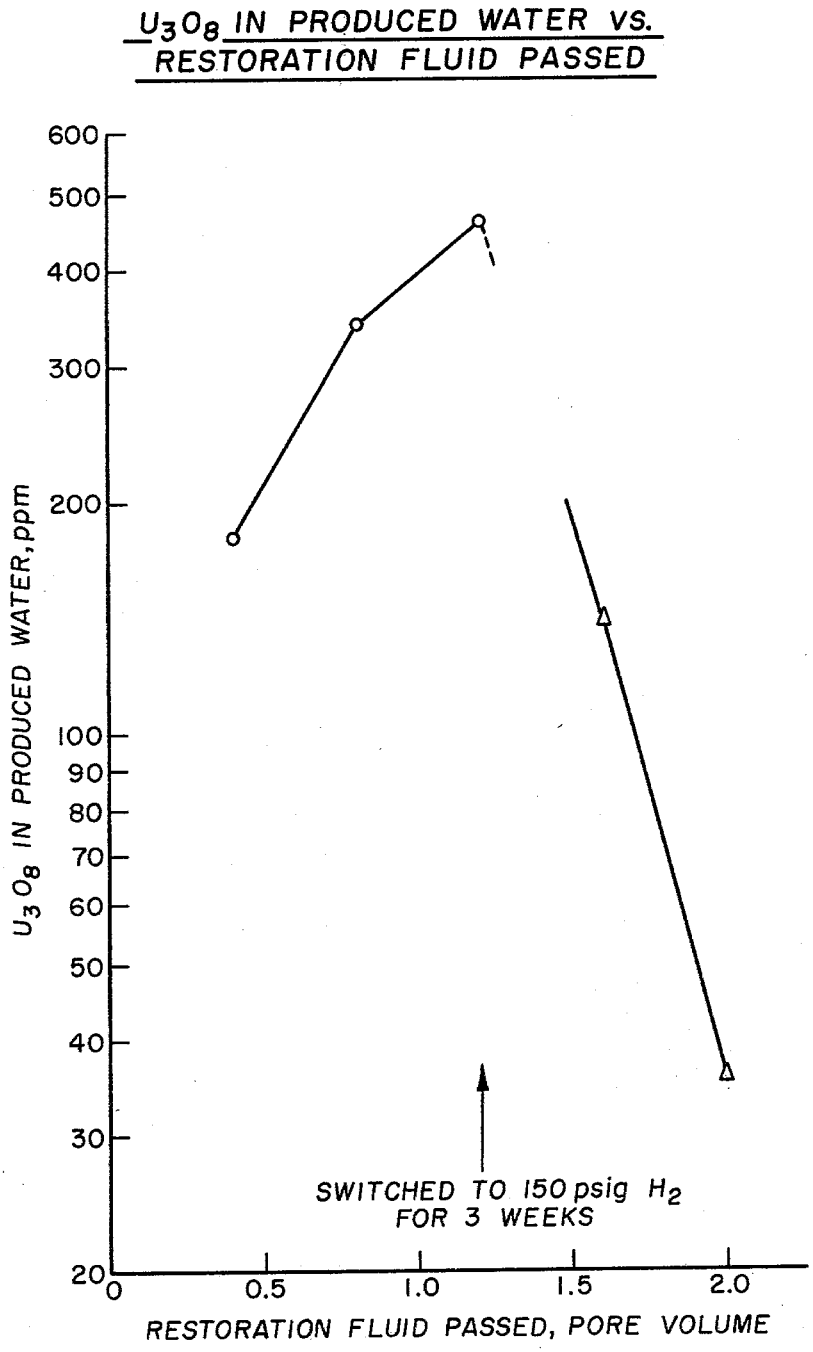
$U_3O_8$ IN PRODUCED WATER VS. RESTORATION FLUID PASSED
600
500
400
300
200
100
90
80
70
60
50
40
30
20
$U_3O_8$ IN PRODUCED WATER, ppm
SWITCHED TO 150 psig $H_2$ FOR 3 WEEKS
0
0.5
1.0
1.5
2.0
RESTORATION FLUID PASSED, PORE VOLUME

METHOD FOR RESTORING A LEACHED FORMATION

BACKGROUND OF THE INVENTION

The present invention relates to a method for restoring a formation which has undergone an in situ leaching operation and more particularly relates to a method for restoring a previously leached formation so that oxidized mineral values in the formation will not contaminate ground waters after the leach operation has been completed.

In a typical in situ leach operation, wells are completed into a mineral-bearing formation (e.g. uranium) and a leach solution is flowed between wells to dissolve the uranium values into the leach solution. The leach solution is then produced to the surface to recover the uranium values. As is well known, uranium and other leachable minerals often occur in the formation in a reduced state and must be oxidized in order to render them soluble in the leach solution. To oxidize the minerals, an oxidant (e.g. oxygen, hydrogen peroxide, etc.) is flowed through the formation prior to or along with the leach solution.

Unfortunately, where the leached formation also contains ground waters and/or a water source that may have originally been suitable for surface use, the oxidized mineral values such as uranium and molybdenum remaining in the formation after a commercial recovery operation is completed pose a severe contamination threat to the formation waters. This is due to the fact that the oxidized values remaining in the formation will continue to dissolve into the formation water and will be produced therewith. If the amount of a particular mineral in the produced formation water exceeds the recognized safety level for that particular mineral, the formation must be treated after a leach operation to remove the threat of contamination from these oxidized minerals and to restore the purity of the formation water to substantially its original base line quality.

SUMMARY OF THE INVENTION

The present invention provides a method for restoring a leached formation having oxidized, soluble minerals therein which pose a contamination threat to the waters in the formation.

Specifically, the leached formation is flushed with a restoration fluid which contains a reducing agent which is capable of reducing the oxidized minerals to their reduced insoluble state. Although any reducing agent capable of doing this can be used, due to cost and environmental considerations, hydrogen gas, carbon monoxide, hydrogen sulfide, sulfur dioxide, and ferrous iron solutions are preferred. Where gaseous reducing agents are used, they are mixed into an aqueous carrier fluid, e.g. water, for best results.

In carrying out the present invention, a commercial leach operation is terminated when the desired mineral concentration in the leach solution drops below an economical value. The injection and production wells used in the commercial leach are then shut in for a period (e.g. at least one week) sufficient to allow all unreacted oxidant in the formation to become exhausted. Next, at least one pore volume of formation fluids is produced. These produced fluids will normally contain enough of the desired mineral to justify processing these fluids for recovery of the mineral.

Next, at least one pore volume of restoration fluid containing a reducing agent is injected into the formation while at the same time equal amounts of formation fluids are being produced. All wells are then shut in for a period (at least two weeks) to allow the reducing agent to reduce the oxidized minerals to their insoluble state and redeposit the insoluble minerals back into the formation. Finally, the formation is flushed with deaerated and preferably desalinated water until the concentration of the contaminating mineral drops below an acceptable value. The actual operation and apparent advantages of the present invention will be better understood by referring to the following detailed description.

BRIEF DESCRIPTION OF THE DRAWING

The FIGURE is a graph showing experimental results of passing restoration fluid through an ore containing oxidized uranium values in accordance with the present invention.

DESCRIPTION OF THE PREFERRED EMBODIMENTS

In a typical in situ leach operation for recovering a mineral value such as uranium, wells are completed into a uranium bearing formation and a leach solution is flowed between wells. Since uranium is normally found in its tetravalent stage and must be oxidized to its hexavalent stage to become soluble in commercially used leach solutions, an oxidant (e.g., oxygen) is also flowed through the formation prior to or along with the leach solution. During the recovery operation other minerals and/or metals, e.g., molybdenum, are oxidized and become soluble in the leach solution. These oxidized values are produced with the leach solution to the surface where they are recovered from the leach solution.

The leach operation will continue until the concentration of the desired value, e.g. uranium, in the leach solution drops below the concentration at which uranium can be commercially produced. When this concentration is reached, the commercial recovery operation is terminated.

However, upon the termination of most commercial operations, the uranium content of the formation will not be completely depleted and a substantial amount of uranium may still be present. Some of this remaining uranium will have been oxidized during the leach operation and, being soluble, will bleed into any formation water that may be present in the formation. This is also true of other oxidized minerals, e.g. molybdenum, in the formation. Where this formation water may otherwise be suitable for surface use, this bleeding of oxidized uranium, molybdenum, and/or other minerals into this water poses a severe contamination threat. If the amount of a contaminant in any produced formation water exceeds the recognized safety limit of that contaminant, the formation will have to be treated to remove the contamination threat posed by the remaining oxidized mineral values to thereby ensure that further produced formation water is safe for its intended use.

In accordance with the present invention, upon completion of a commercial in situ uranium leach operation, a restoration method is carried out wherein the leached formation is flushed with a restoration fluid comprising a reducing agent capable of reacting with the remaining oxidized mineral and/or metal values in the formation to reduce them back to their original insoluble stage. Although any suitable reducing agent can be used, based on costs and environmental considerations, hydrogen gas, carbon monoxide, hydrogen sulfide, sulfur dioxide, and ferrous iron solutions are preferred for use as reductants in the present invention.

More specifically, the present restoration method is carried out as follows. When the uranium values in the leach solution reach the commercial cut-off level, the leaching operation stops and restoration operation starts. The restoration operation is started by shutting in all wells for a minimum of one week, preferably three to four weeks, to exhaust any oxidants that may be present or remain in the formation from the leach operation.

Next, at least one pore volume (PV), preferably two to three PVs, of formation fluids is produced from production wells without injection of any fluid into the formation. The uranium concentration in this produced fluid will be higher than that of the leach solution prior to shut in, so that the uranium values in this produced fluid are preferably recovered using the same procedures as used during the original commercial leaching operation.

At least one PV, preferably two to three PVs, of restoration fluid containing reducing agent is next injected into the formation. Where a gaseous reducing agent (e.g. hydrogen gas, carbon monoxide, hydrogen sulfide, or sulfur dioxide) is used, it is preferably mixed into an aqueous medium (e.g. water) for injection. Preferably, the gaseous reducing agent is mixed with water at the bottom of the well just before injection into the formation by the techniques disclosed in copending U.S. application Ser. No. 846,863, filed Oct. 31, 1977. Where other reducing agents are used, they may be mixed at the surface before injection. For example, ferrous chloride or ferrous sulfate is mixed with water at the surface to provide a restoration fluid containing ferrous ions. During injection of the restoration fluid, substantially equal volumes of formation fluids should be produced to thereby maintain the restoration fluid within the original leached area of the formation. It is preferred, if at all feasible, to reverse the functions of the injection and production wells from those performed by the respective wells in the original leach operation.

Next, all wells are shut in for a minimum of two weeks, preferably three to four weeks. This provides the reaction time required for reduction of uranyl ions to insoluble compounds and to redeposit the insoluble compounds back into the formation.

Finally, deaerated connate water is injected into the formation and equal or slightly more formation fluids are produced to flush the formation until the quality of the produced fluids, i.e. water, reaches the desired level. To speed up the operation, deaerated and/or desalinated water (i.e., the connate water is desalinated) can be used for injection in lieu of the deaerated connate water. In this step, reversal of injection and production wells is again preferred.

To better illustrate the present invention, the following experimental data are set forth. Three pressure bombs A, B, and C were each loaded with 10 grams of an ore which had been previously leached to recover uranium. The leached ore contained 0.071% $U_3O_8$ according to assay. The ore was loaded into each pressure bomb along with 50 cc of solution containing 3 g/l of $NaHCO_3$. Bomb A was pressurized and saturated with 150 psig of $N_2$. Bomb B was pressurized and saturated with 150 psig of $H_2$. Bomb C was pressurized and saturated with 15 psig of $H_2S$. All bombs were placed in a shaker for 140 hours. The mixtures were separated using a centrifuge and the clear solutions were analyzed using the colorimetric method.

The results are as follows:

| Bomb | Gas | Press. psig | $U_3O_8$ in Sol'n. ppm | $U_3O_8$Leached Percent |
|---|---|---|---|---|
| A | $N_2$ | 150 | 39 | 27.0 |
| B | $H_2$ | 150 | 1 | 0.7 |
| C | $H_2S$ | 15 | 22 | 15.0 |

The above results clearly indicate that by use of $H_2$ reductant at 150 psig, the uranyl ion which is soluble in the $NaHCO_3$ leach solution can be reduced to insoluble forms (compare results of A and B). The other reductant, $H_2S$ at 15 psig, is also effective, even though it is not as effective as $H_2$ at 150 psig (compare results of B and C).

Further, tests were conducted using a column filled with a rich ore containing 0.62% of $U_3O_8$ which was leached with a leach solution of ammonium carbonate and an oxidant of sodium chlorate. At the end of the leaching operation, 60.3% of $U_3O_8$ had been leached. This column of ore was opened and left dry for about one year before using in the restoration test. In the restoration test, the restoration fluid containing 2 g/l of $NaHCO_3$ and 1 g/l of NaCl (pH adjusted to 6.5) was deaerated with $H_2$ at atmospheric pressure before use. This fluid was injected at 100 cc/day (0.67 PV/day). After injecting 1.4 PVs, the pump was stopped and $H_2$ gas at 150 psig was passed over to saturate the formation. The column was kept in 150 psig of $H_2$ for three weeks, and then, pumping of the restoration fluid was resumed. The uranium contents of the produced water were analyzed using x-ray with the results being shown in the FIGURE. Because much of the uranium left in the ore was oxidized before the restoration test, the uranium level of the produced water was high, i.e., it reached 460 ppm when it was switched to $H_2$ gas reduction. After a reduction period of three weeks, the uranium level in the produced water dropped rapidly to 35 ppm indicating much of the oxidized uranium had been reduced to insoluble uranium.

From the above, it can be seen by flushing a previously leached formation with a restoration fluid which contains a reductant or reducing agent, the oxidized contaminants in the formation can be reduced to their insoluble state thereby eliminating a serious source of contamination for any waters in the formation.

I claim:

1. A method of restoring a formation which has had mineral and/or metal values therein oxidized by an oxidant during an in situ leach operation, said formation having at least one injection well and at least one production well completed therein, said method comprising:

a. shutting in said at least one injection well and said at least one production well at the completion of said in situ leach operation, said wells being shut in for a period necessary to exhaust any unreacted said oxidant that may be present in said formation;

b. producing at least one pore volume of fluid from said formation at the end of said shut in period of step a.;

c. injecting into said formation at least one pore volume of a restoration fluid containing a reducing agent capable of reducing said oxidized mineral and/or metal values to their reduced, insoluble state;

d. shutting in said at least one injection well and said at least one production well for a period necessary to provide the reaction time for the reduction of said oxidized mineral and/or metal values; and e. injecting deaerated water into said formation and producing fluids from the formation until the concentration of oxidized mineral and/or metal values in the produced fluids reach a desired level.

2. The method of claim 1 wherein said mineral and/or metal value comprises:

uranium; and wherein said reducing agent comprises:

hydrogen gas.

3. The method of claim 1 wherein said mineral and/or metal value comprises:

uranium; and wherein said reducing agent comprises:

hydrogen sulfide.

4. The method of claim 1 wherein said mineral and/or metal value comprises:

uranium; and wherein said reducing agent comprises:

sulfur dioxide.

5. The method of claim 1 wherein said mineral and/or metal value comprises:

uranium; and wherein said reducing agent comprises:

carbon monoxide.

6. The method of claim 1 wherein said mineral and/or metal value comprises:

uranium; and wherein said reducing agent comprises:

ferrous iron solution.

7. The method of claim 1 wherein said shut in period of step a. comprises:

a minimum of one week.

8. The method of claim 7 wherein said shut in period of step d. comprises:

a minimum of two weeks.

9. The method of claim 1 including:

desalinating said deaerated water before injecting into said formation.

10. The method of claim 1 wherein step c. includes:

producing at least one pore volume of formation fluids while injecting said restoration fluid.

11. The method of claim 10 wherein in step c. said restoration fluid is injected through said at least one production well and said formation fluids are produced through said at least one injection well.

12. The method of claim 11 wherein in step e. said deaerated water is injected through said at least one production well and said produced fluids are produced through said at least one injection well.

* * * * *